United States Patent [19]

Ulveling et al.

[11] 4,195,825

[45] Apr. 1, 1980

[54] COMPACT APPARATUS FOR DRILLING AND PLUGGING TAP HOLES

[75] Inventors: Leon Ulveling, Howald; Jean Metz, Luxembourg, both of Luxembourg

[73] Assignee: Paul Wurth S.A., Luxembourg, Luxembourg

[21] Appl. No.: 943,223

[22] Filed: Sep. 18, 1978

[30] Foreign Application Priority Data

Sep. 30, 1977 [LU] Luxembourg ..... 78209

[51] Int. Cl.[2] ..... C21B 7/12

[52] U.S. Cl. ..... 266/271; 266/45; 266/273

[58] Field of Search ..... 266/271, 272, 273, 45

[56] References Cited

U.S. PATENT DOCUMENTS

| | | | |
|---|---|---|---|
| 3,190,629 | 6/1965 | Draper | 266/271 |
| 3,549,141 | 12/1970 | Zimmermann | 266/273 |
| 3,765,663 | 10/1973 | Legille et al. | 266/273 |
| 4,097,033 | 6/1978 | Mailliet | 266/271 |

*Primary Examiner*—L. Dewayne Rutledge
*Assistant Examiner*—Peter K. Skiff

[57] ABSTRACT

A compact apparatus for drilling and plugging a tap hole of a shaft furnace, the furnace including a tap channel through which molten metal may flow, the tap channel extending from the tap hole in a direction generally radially with respect to the axis of the furnace. The apparatus for drilling and plugging the tap hole includes a drilling device and a plugging device, each device mounted on the end of an arm, the arm pivotably mounted about an axis inclined from the vertical to allow movement of the devices in an inclined plane between a position of retraction and a position of operation. The arm of the drill device and the arm of the plugging device are positioned on one side of the tap channel and are installed on the tap floor. The axes of the drill and plugging devices are tilted with respect to each other and with respect to the vertical to allow the device nearest to the furnace to pass over the device farthest from the furnace when both devices are in the retracted position.

5 Claims, 6 Drawing Figures

COMPACT APPARATUS FOR DRILLING AND PLUGGING TAP HOLES

This invention is concerned with an apparatus for drilling and plugging tapholes in a shaft furnace, consisting of a drill and plugging device, well known in themselves, mounted on the pouring floor alongside a tapspout, each forming an independent unit and consisting essentially of a working piece mounted on the end of an arm the other end of which is free to move about an axis inclined from the vertical, to move the working piece through an inclined plane, between a retracted position and an operative position.

In addition to requirements arising directly out of the functions for which a drill and plugging device are designed, viz., simple, efficient operation, robust, simple and durable construction, ease of handling, retracted position far away from the tapspout, these machines must also meet certain other requirements, so far as possible. So, in particular, it is preferable that the working platforms erected around modern blast furnaces are not interrupted to permit these machines to operate. Another requirement is that, in the withdrawn position, the working piece is as low as possible, particularly in the interests of ease of maintenance and also to facilitate re-filling the plugging device.

Machines like those described in the preamble and meeting these various requirements are described in U.S. Pat. No. 4,097,033, as regards the drill and, as regards the device for plugging tapholes, in U.S. Pat. No. 3,765,663. A feature common to these two machines is their reduced height, which allows them to meet the additional requirements mentioned earlier in a manner which is generally satisfactory.

Nevertheless, these two machines, like all others of the type described above, suffer from the drawback that they amount to a not inconsiderable encumbrance in the area of the taphole of a furnace. In practice, each taphole has a drill and plugging device of this type, positioned around the tapspout and for each of these machines space must be allowed, at least equivalent to the area swept by the end of the working piece of each of these machines. Moreover, this problem of encumbrance is aggravated by recent progress in this field, allowing increased furnace yield by increasing the size of furnace and by operating conditions, especially increased back pressure. Consequently, this development requires not only larger and more powerful machines, but also an increase in the number of tapholes and therefore an increase in the number of machines.

To reduce the extent of encumbrance, a proposal has already been made to combine a drill and plugging device and the fruit of this proposal is a machine of the type described in U.S. Pat. No. 3,549,141. This machine incorporates a clay gun and a drill, mounted side by side in parallel on a rotary member which can revolve about a vertical axis and which are directed in opposite directions to each other, the rotary member being mounted on the end of an arm which can pivot about a support column.

However, this proposal was only brought to fruition at the expense of certain criteria previously described, which define the appearance of the ideal machine. In fact, by mounting the two working tools on the end of the arm, this then has to support a fairly considerable weight, the more so since supplementary, complicated machinery is needed, viz., the rotary device, the presence of which reduces the rigidity of the whole assembly. This results in a heavy, bulky and above all, relatively high structure.

Another drawback to such a combination is that, if the machine breaks down, both drill and plugging device are out of service. Another disadvantage of this machine arises inevitably when it is adjusted because, if we adjust say, the drill, we are bound to upset the adjustment of the plugging device and vice versa, not forgetting that the drill mounting is liable to be splashed with molten metal when stopping is in progress.

The object of this invention is to produce a compact apparatus of the type described above, which permits a significant reduction in the space occupied around the furnace, whilst retaining all the advantages offered separately by the plugging device and the drill.

According to the present invention there is provided an apparatus for drilling and plugging tapholes in a shaft furnace, consisting of a drill and a plugging device, well known in themselves and installed on the pooring floor, alongside a tapspout, each forming an independent unit and comprising basically a working piece mounted on the end of an arm, the other end of which is free to move about an axis inclined from the vertical to move the working piece in an inclined plane between a retracted position and an operative position, wherein the plugging device and drill are juxtapositioned on the same side of the tapspout and the pivoting axes of the drill and plugging device are tilted in such a way, with respect to each other and to the vertical that the inclined plane of pivot of the unit nearest to the furnace passes over the unit farthest away when that unit is in the rest position. In a preferred embodiment of the invention the plugging device is nearer the furnace and tapspout then the drill. The parameters of the inclined planes through which the drill and the clay gun operate are established preferably by clearly determined inclination of the pivots about which their arms pivot. A judicious combination of these two degrees of tilting achieves the desired relationship between the degree of tilting of pivoting axes and consequently of the inclined planes. In a preferred embodiment, the axis of the pivot about which the clay gun swings is inclined, through a plane parallel to the tapspout in the direction of the furnace, whilst the axis of the pivot about which the drill swings is inclined, through a plane perpendicular to the tapspout, in the opposite direction thereto.

In machinery embodying these features, the advantages of the drill and plugging device, well known in themselves, are retained. Moreover, the total height of the compact machinery does not exceed that of the tallest machine and the horizontal bulk does not exceed that of the most bulky of the two units.

The present invention may be better understood and its objects and advantages will become apparent to those skilled in the art by reference to the accompanying drawings, in which.

Figure 1:
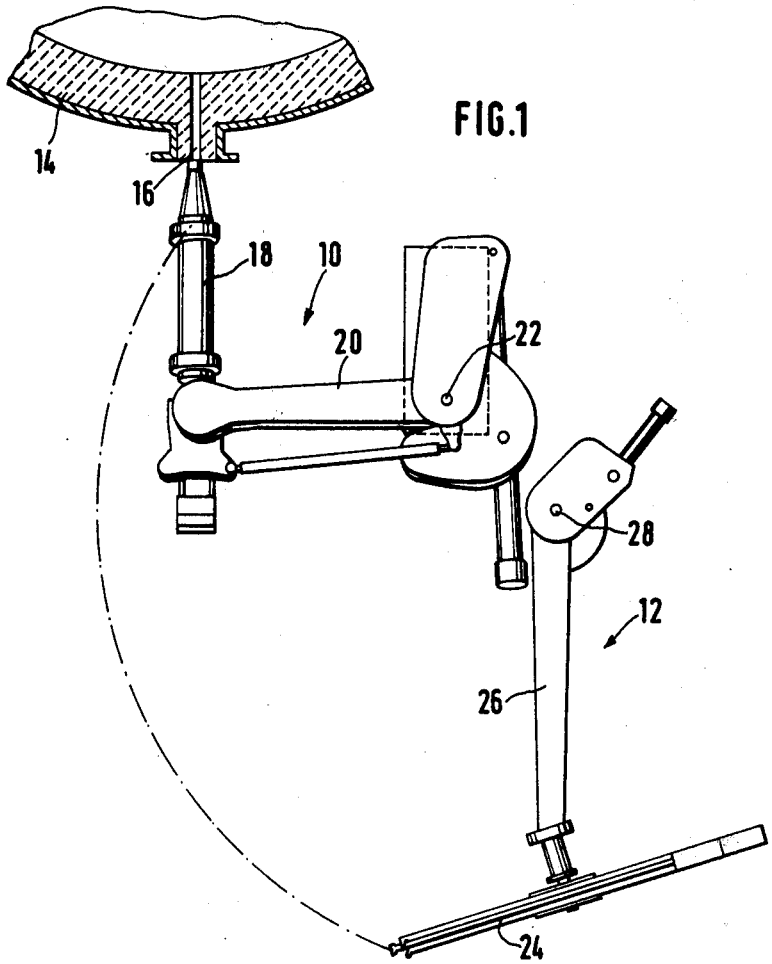
FIG. 1 shows diagrammatically a plan view of a machine with the plugging device in the operational position and the drill in the retracted position.
Figure 2:
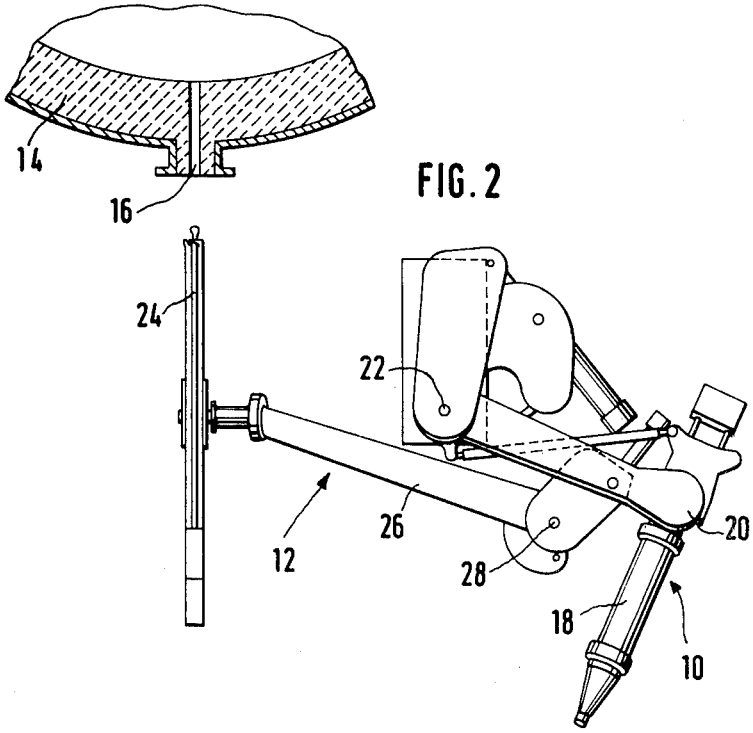
FIG. 2 shows a plan view of a machine with the drill in the operational position and plugging device in the retracted position.
Figure 3:
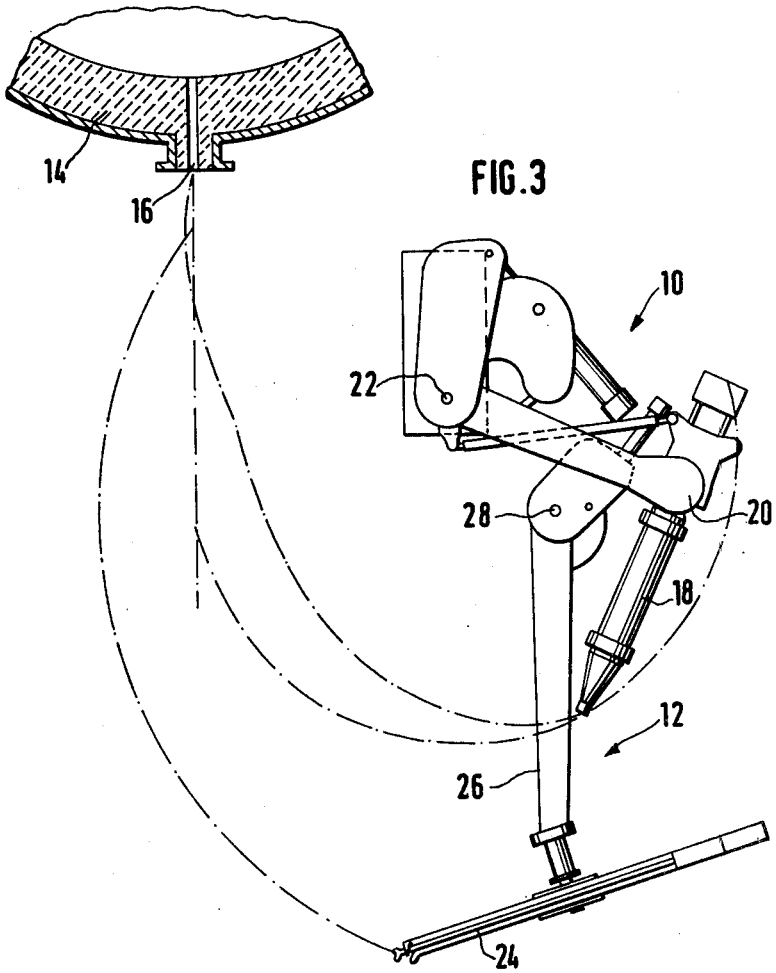
FIG. 3 shows a plan view of a machine in which the drill and the plugging device are in their retracted position.

In FIGS. 1 to 3 part of the wall, 14, of a blast furnace has been shown diagrammatically. A taphole 16 passing through this wall is prolonged externally by a tapspout not shown in FIGS. 1 to 3. Alongside this tapspout, on the so-called "pooring floor", are mounted a plugging device 10 and drill 12, both well known in themselves.

Plugging device 10 consists basically of clay gun 18 articulated at the end of arm 20, the other end of which swings about pivot 22. Likewise, drill 12 comprises working tool 24 fitted at the end of arm 26, the other end of which pivots at 28. For further information on the working and construction of these two machines, reference should be made to U.S. Pat. No. 3,765,663 for the plugging device and U.S. Pat. No. 4,097,033 for the drill. However, it is quite clear that each of these two machines can be modified so as to perform their specific functions better or to fit into the available space. Thus, for instance, it can be provided, between working tool 24 and its arm 26 for articulation and arm 26 can be designed in the form of a parallelogram so that, when drill 12 is in the retracted position, the working tool 24 has a well defined orientation in relation to arm 26. In this way it is possible to cause working tool 24 to be lowered automatically to a position parallel to arm 26 in the retracted position.

In principle, each of units 10 or 12 can be deployed internally, i.e., nearer the blast furnace and tapspout, but, bearing in mind that the plugging device is usually more solidly and massively constructed, and for this reason and in order to accommodate the required pressures, has a shorter arm, it is preferable to have the plugging device between the drill and the blast furnace.

As can be seen by reference to FIGS. 2 and 3, plugging device 10, when in the retracted position, lies partly over pivot 28 of the drill. The degree of tilt of pivot 22 of plugging device 10 is such that the inclined plane swept by the clay gun when it pivots is lowered towards the furnace. The tilt of pivot 22, the position of pivot 28 and the position of drill 12 when at rest will be chosen so that the highest point of clay gun 18 when moving through the inclined plane between its retracted and operative positions and vice versa lies approximately above the retracted position of drill 12. This angle of inclination of the pivoting plane of the plugging device 10 thus ensures that gun 18 is in a low position, whether in the operative or retracted positions.

The angle of inclination of pivot 28 of drill 12 is such that at rest it is in a low position, that the highest point of the working tool 24 lies somewhat between the rest and operational positions, and that the operational position of working tool 24 is again a low position in which the drilling head points downwards according to the desired slope of the taphole.

Figure 4:
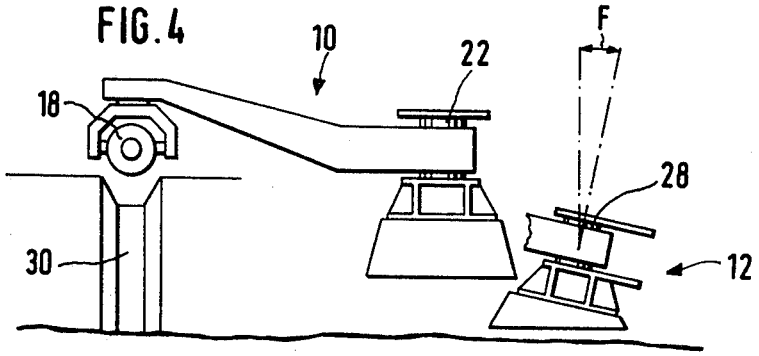
FIGS. 4 and 5 show diagrammatic views respectively in a direction parallel to the tapspout and perpendicular to the tapspout to illustrate the angles of tilt.

In FIG. 4 it can be seen that the axis of pivot 22 and consequently the revolving axis of plugging device 10 is appreciably parallel to a vertical plane passing through the tapspout, represented by 30 in this drawing. However, it is possible to tilt this axis slightly a few degrees, to left or right in FIG. 4 according to the conditions applied to the trajectory of clay gun 18.

Figure 5:
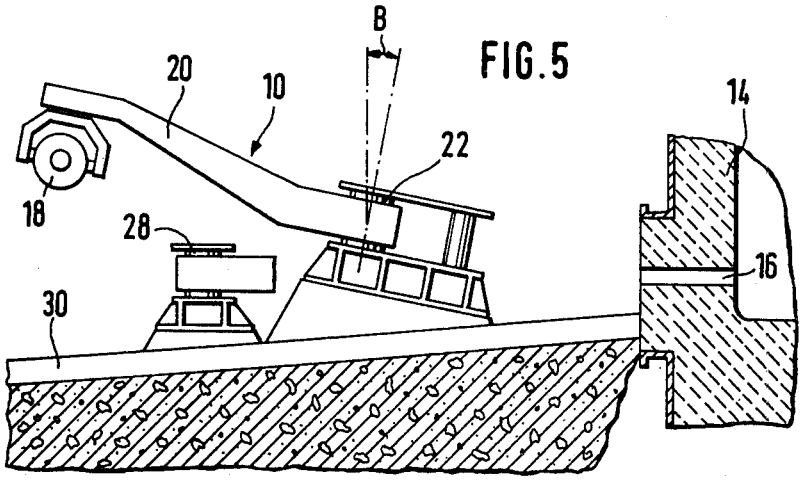

On the other hand, as shown in FIG. 5, the axis of pivot 22 is tilted towards furnace wall 14 at an angle represented by B. This angle can lie between 10° and 20° according to the size of plugging device 10 and the clearance between it and drill 12.

Pivot 28 of drill 12 is tilted, as shown in FIG. 4, in a plane perpendicular to tapspout 30 by an angle F which can also vary between 10° and 20° according to the conditions imposed. In a plane parallel to tapspout 30, the axis of pivot 28 is appreciably vertical or tilted slightly to one side or another at an angle of a few degrees, as required.

FIG. 3 shows that the layout of the plugging device and drill in accordance with this invention only takes up as much room on the pooring floor as would be occupied by the drill alone. In fact, the curves described by the two extremities of the clay gun 18 when it pivots between operational and retracted positions remain constantly within the trajectory of the extremity of drill 12. Therefore the space gained by this invention equals the space needed to mount and operate a plugging device and this applies to each pair of machines.

Arranging the drill 12 and the plugging device 10 in pairs also facilitates hydraulic fluid feed from a central point, subject to control and feed in common.

Figure 6:
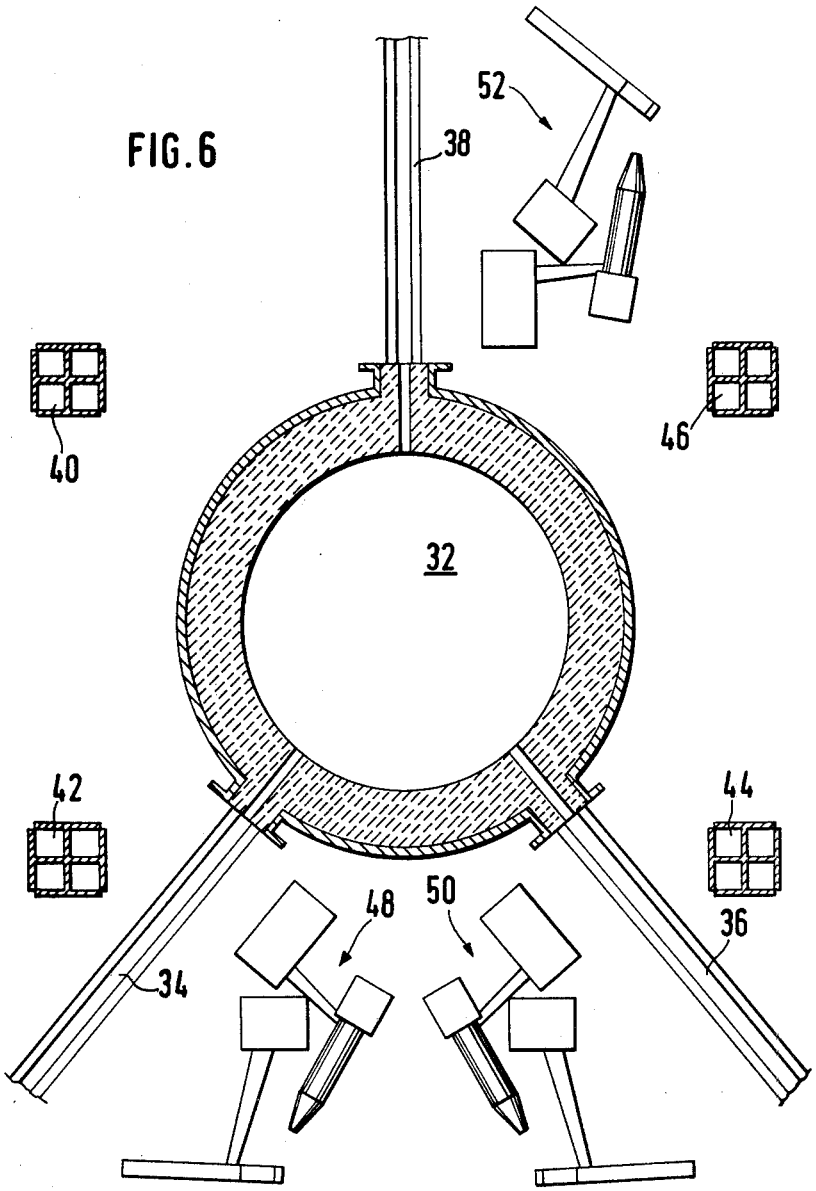
FIG. 6 shows a plan view of a blast furnace, fitted with several machines in accordance with the invention.

FIG. 6 shows a general view of several machines in accordance with the invention, grouped around a blast furnace 32. This is a blast furnace with three tapspouts, 34, 36 and 38. These tapspouts are not necessarily arranged in regular sequence around the furnace, because the arrangement of them largely depends on the positioning of the equipment for treating slag and receiving the molten metal. The arrangement shown in FIG. 6 is nevertheless a typical example.

References 40, 42, 44 and 46 represent diagrammatically towers and define a frame work, used to support the whole superstructure of the blast furnace.

Three machines 48, 50, 52 according to this invention, each comprising a plugging device and drill are associated respectively with tapspouts 34, 36 and 38. One can easily see that if in each installation the plugging device and drill were deployed all around the tapspout, these six machines would form a cumbersome ring all around the furnace, whereas, in accordance with this invention, the drills and plugging devices are grouped in three compact installations. This arrangement makes it feasible to site each machine so that all plugging devices and drills are readily accessible from the pooring floor and they do not get in the way of other equipment or impede other operations.

In a blast furnace such as depicted in FIG. 6 it is moreover difficult to install machines on each side of the tapspouts 34 and 36 because towers 42 and 44 get in the way. Up to now it has been necessary to engage in some geometric ingenuity, notably a cranked arm which would allow the clay gun or the drill to be brought round the offending tower into a retracted position far enough away from the tapspout. However, this arrangement makes it difficult and dangerous to gain access to the drill, plugging device, or tower in question.

The grouped arrangement of machines 48 and 50 between towers 42 and 44 makes them readily accessible via the gantry usually found in the pooring room above the tapspouts. If, as in the above example, a plugging device or drill had to be positioned between each of towers 42 and 44 and furnace 32, this machine would no longer be accessible via the gantry and it would be necessary to design other handling machinery, especially for these machines.

Similar reasoning applies to other tapspout arrangements than that depicted in FIG. 6.

We claim:

1. An installation for opening and closing a taphole of a blast furnace, the furnace having a generally vertically oriented axis, the taphole communicating with a pouring channel whereby molten metal may be withdrawn from the furnace, the taphole and pouring channel having axes which lie in a common vertical plane, the installation comprising:

first tool means, said first tool means including plugging means for use in plugging a taphole, said plugging means having a longitudinal axis;

second tool means, said second tool means including drill means for use in opening said taphole, said drill means having a longitudinal axis;

a floor, the pouring channel associated with said taphole comprising an irregularity in said floor;

means supporting said first tool means above said floor, said first tool means supporting means being mounted on said floor at a first side of the pouring channel and including:

first pivot means, said first pivot means having an axis which is inclined with respect to the furnace axis; and first elongated arm means, said first tool means being mounted from a first end of said first arm means, said first arm means being pivotal about said first pivot means axis whereby said first tool means may be moved between an operative position with the tool axis positioned in said common vertical plane and a retracted position, the first tool means axis being constrained to an inclined plane during such movement;

means supporting said second tool means above said floor, said second tool means supporting means being mounted on said floor on the said first side of the pouring channel and at a point displaced from said first tool means supporting means, said second tool means supporting means including:

second pivot means, said second pivot means having an axis which is inclined with respect to said common vertical plane and with respect to said first pivot means axis; and second elongated arm means, said second tool means being mounted from a first end of said second arm means, said second arm means being pivotal about said second pivot means axis whereby said second tool means may be moved between an operative position with the second tool means axis positioned in said common vertical plane and a retracted position, the second tool means axis being constrained to an inclined plane during such movement;

the angles of inclination of said pivot means and the relative heights and the relative locations on said floor of said pivot means being selected such that the point of maximum elevation of the plane in which the axis of one of said tool means moves lies in a vertical plane through the axis of the other of said tool means when the said other of said tool means is in its retracted position.

2. The apparatus of claim 1 wherein the said one of said tool means is said first tool means and wherein said first pivot means extends a greater distance above said floor than said second pivot means whereby said plugging means will pass over the drill means in its retracted position when said plugging means moves between the operative and retracted positions.

3. The apparatus of claim 2 wherein said first pivot means is mounted on said floor at a point which is closer to the furnace axis and to the pouring channel than said second pivot means.

4. The apparatus of claim 3 wherein the axis of said first pivot means lies in a plane generally parallel to said common vertical plane.

5. The apparatus of claim 4 wherein the axis of said second pivot means lies in a plane which is generally transverse to the axis of the pouring channel.

* * * * *